US007419395B2

(12) United States Patent
Tsuji et al.

(10) Patent No.: US 7,419,395 B2
(45) Date of Patent: Sep. 2, 2008

(54) SMALL DOUBLE-LOCKING WATERPROOF CONNECTOR

(75) Inventors: Takeshi Tsuji, Yokkaichi (JP); Michiaki Okamoto, Yokkaichi (JP); Hiroki Hirai, Yokkaichi (JP); Chikahiro Yoshioka, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/667,074

(22) PCT Filed: Nov. 16, 2005

(86) PCT No.: PCT/JP2005/021004

§ 371 (c)(1),
(2), (4) Date: May 4, 2007

(87) PCT Pub. No.: WO2006/054574

PCT Pub. Date: May 26, 2006

(65) Prior Publication Data

US 2008/0113543 A1 May 15, 2008

(30) Foreign Application Priority Data

Nov. 17, 2004 (JP) ..... 2004-333422

(51) Int. Cl.
*H01R 13/52* (2006.01)

(52) U.S. Cl. ..... 439/271; 439/587

(58) Field of Classification Search ..... 439/271, 439/274, 595, 587
See application file for complete search history.

(56) References Cited

U.S. PATENT DOCUMENTS

| | | | | |
|---|---|---|---|---|
| 6,053,754 | A * | 4/2000 | Kano et al. | 439/281 |
| 6,364,692 | B1 | 4/2002 | Okayasu et al. | |
| 6,520,788 | B2 * | 2/2003 | Ichida et al. | 439/271 |
| 2001/0055907 | A1 * | 12/2001 | Murakami et al. | 439/595 |
| 2003/0190830 | A1 | 10/2003 | Tanaka et al. | |

FOREIGN PATENT DOCUMENTS

| | | |
|---|---|---|
| JP | A 2000-348813 | 12/2000 |
| JP | A 2003-123895 | 4/2003 |
| JP | A 2003-297479 | 10/2003 |
| JP | A 2004-172034 | 6/2004 |

* cited by examiner

*Primary Examiner*—Hae Moon Hyeon
(74) *Attorney, Agent, or Firm*—Oliff & Berridge, PLC

(57) ABSTRACT

A object of the present invention is to enable a double-locking of female terminals without making a whole connector larger in size or complicating a structure thereof while maintaining fine waterproof function. A female connector includes a female housing for retaining a female terminal and a seal member holder. The seal member holder retains a seal member having through holes. When the seal member holder is completely attached to the female housing, the seal member comes in close contact with a front surface of the female housing. In this state, a male terminal of a male connector fits into the female terminal so that a projecting portion of the female connector comes in close contact with an inner surface of the through hole to make terminals waterproof individually. Further, the seal member holder is provided with a double-locking piece in, which pursues the double locking of the female terminal in the female housing at the time of the complete attachment.

6 Claims, 9 Drawing Sheets

SMALL DOUBLE-LOCKING WATERPROOF CONNECTOR

This is a National Stage of Patent Application No. PCT/JP2005/021004 filed Nov. 16, 2005, which claims the benefit of U.S. Japanese Patent Application No. 2004-333422 filed Nov. 17, 2004. The disclosures of the prior applications are hereby incorporated by reference herein in their entirety.

TECHNICAL FIELD

The present invention relates to a waterproof connector having a function to waterproof each terminal individually.

BACKGROUND ART

It is generally recognized that a conventional waterproof connector is provided with a seal member surrounding a plurality of terminal accommodating chambers and collectively waterproofs the entire terminal accommodating chambers with the seal member. However, such configuration requires a space for mounting the seal member to be secured on further exterior side from each terminal accommodating chamber, and this causes a disadvantage that a size of the whole connector becomes larger in a direction perpendicular to an axial direction of the connector. Therefore, to make the size of the connector be small, a waterproof connector having an individual waterproof function as described in the below-listed patent document 1 has been under development.

As shown in FIG. 9, the waterproof connector includes a female connector C1 in which a plurality of female terminals 110 are retained by a female housing 112, and a male connector C2 in which male terminals 120 to be inserted respectively to the female terminals 110 are retained by a rear section 122.

The female housing 112 of the female connector C1 includes terminal accommodating chambers 112*c* for accommodating the female terminals 110 respectively, and lances 113 for locking the female terminals 110 respectively in the terminal accommodating chambers 112*c*. Further, the female housing 112 has a housing front wall 112*a* formed with male terminal insertion holes 112*b* into which the male terminals 120 to fit into the female terminals 110 respectively are insertable from the front side. Further, a seal member 114 made of an elastic member such as rubber has close contact with the housing front wall 112*a*, and a seal member holder 116 is attached to a front end portion of the female housing 112 so as to cover the seal member 114 from the front side. The seal member 114 is formed with through holes 114*a* aligned respectively with the terminal insertion holes 112*b*. Similarly, a front wall of the seal member holder 116 is formed with projection through holes 116*a* aligned respectively with the through holes 114*a*.

On the rear side of each female terminal 110, a seal member 118 comes in close contact with an electric wire W onto which the female terminal 110 is crimped, to accomplish waterproofing.

On the other hand, the male connector C2 is a connector mountable onto a substrate in the drawing example. Each male terminal 120 in the male connector C2 has a pin-like shape. The male terminal 120 has one end portion as a mounting portion 120*a* to be mounted on a substrate P, and the other end as an electric connection portion 120*b* to fit into a corresponding female terminal 110. The rear section 222 integrally includes a main body wall 123 for retaining the middle portion of the male terminal 120, and a hood 124 covering the end portion of the male terminal 120 as the electric connection portion 120*b* projecting from the main body wall 123. The female housing 112 and the seal member holder 116 to be mounted thereto are insertable to the hood 124. Further, in the hood 124, there are formed projecting portions 125 projecting from a front surface 123*a* of the main body wall 123 for respective male terminals 120. Each projecting portion 125 has a shape to surround a predetermined portion of the respective male terminal 120, and has an external diameter such that the projecting portion 125 can be inserted into the projection through hole 116*a* of the seal member holder 116 and come in close contact with an inner surface of each of the through hole 114*a* of the seal member 114.

In such waterproof connector, when the electric connection portion 120*a* of each of the male terminals 120 is inserted to the female terminal 110 through the male terminal insertion hole 112*b*, each projecting portion 125 of the rear section 222 is press-inserted into each of the through holes 114*a* of the seal member 114 through each of the projection through hole 116*a* of the seal member holder 116 and comes in close contact with an inner surface of the through hole 114*a* thus making each of the terminals 110, 120 waterproof individually.

Patent Document: Japanese Unexamined Patent Publication No. 2003-297479.

DISCLOSURE OF THE INVENTION

In the female connector C1, in order to ensure the locking of the female terminal 110 in the female housing 112, it is preferable that a double-locking should be pursued in addition to the locking of the female terminal 110 with the lance 113. Means for pursuing such double-locking includes the way of providing a retainer insertion hole in the female housing 112 and inserting a double-locking retainer (for example, a retainer for retaining the lance 113 at a terminal-locking position) into the retainer insertion hole.

However, the addition of such retainer insertion hole and retainer enlarges and complicates the structure of the connector, and increases passages allowing immersion of water into the female housing 112, thus causing a disadvantage that another structure for waterproofing is required to be added.

In view of such circumstances, the technical object of the present invention is to enable double-locking of female terminals without making a whole connector be larger in size or complicating a structure thereof while maintaining a fine waterproof function.

As a way of attaining the above-described object, the present invention includes a waterproof female connector which is to be connected with a male connector, the male connector being provided with a plurality of male terminals each having a front end portion as an electric connection portion, the male terminal projecting forward and held by a male housing, the male housing being formed with projections each projecting from a front surface of the male housing for a corresponding male terminal to cover a rear part of an electric connection portion The waterproof female connector comprises: a plurality of female terminals into which the electric connection portions of the male terminals can fit respectively, a female housing including: terminal accommodating chambers for accommodating the female terminals respectively, terminal locking portions for locking the female terminals in the terminal accommodating chambers respectively, and male terminal insertion holes into which the male terminals to fit into the female terminals can be inserted respectively, the male terminal insertion holes being formed in front of the female terminals; a waterproof seal member made of an elastic material having a shape coming in close contact with a front surface of the female housing; and a seal member holder for holding the waterproof seal member, the seal member being operable to be attached to the female housing in the state the waterproof seal member comes in close contact with the front surface of the female housing. The waterproof seal member is formed with through holes corresponding to the respective male terminal insertion holes of the female housing and has a shape which allows an inner surface of the through hole to come in close contact with an outer surface of the projection of the male housing to prevent immersion of water into the male terminal insertion hole. The seal member holder has double-locking portions which are to be inserted into the female housing from a front side thereof when the seal member holder is attached to the female housing, the double-locking portions pursue double locking of the female terminals to the female housing in the state where the seal member holder is completely attached to the female housing.

In this configuration, when the seal member holder is completely attached to the female housing in the state where each of the female terminals is inserted to each of the terminal accommodating chamber of the female housing and locked by the terminal locking portion, the waterproof seal member retained by the seal member holder comes in close contact with the front surface of the female housing, and the double-locking portion of the seal member holder pursues double-locking of the female terminal in the state of being placed into the female housing from the front side. Then, the male terminal on the side of the male connector is inserted into the through hole of the waterproof seal member and the male terminal insertion hole on the back side, to make the electric connection portion of the male terminal fit into the female terminal. This allows the terminals to electrically communicate with each other, and makes a close contact between the outer surface of the projection of the male housing covering the rear portion of the electric connection portion of the male terminal and the inner surface of the through hole of the waterproof seal member to waterproof each terminal individually.

In other words, this configuration gives the seal member both the function of retaining the waterproof seal member and the function of pursuing the double-locking of the female terminal to enable the double-locking of the female terminal without making a whole connector larger in size or complicating a structure thereof while maintaining a fine waterproof function.

BEST MODE EMBODIMENT FOR CARRYING OUT THE INVENTION

Figure 1:
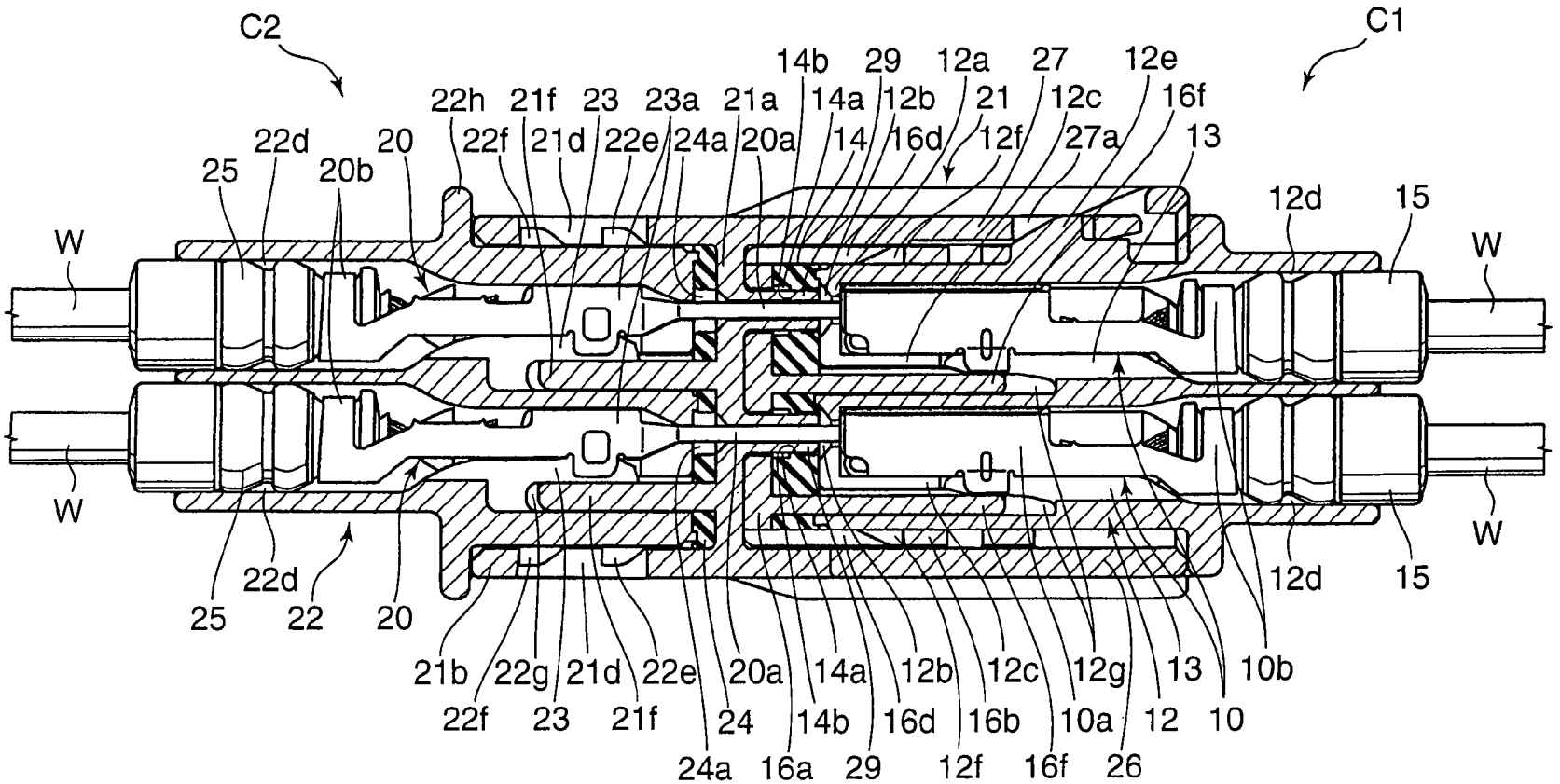
FIG. 1 is a side sectional view showing a connection state of a waterproof connector according to an embodiment of the present invention.

A preferred embodiment of the present invention will be described with reference to the drawings.

The waterproof connector shown in FIG. 1 includes a waterproof female connector C1 (hereinafter, simply referred to as "female connector C1") in which a plurality of female terminals 10 are retained by a female housing 12, and a waterproof male connector C2 (hereinafter, simply referred to as "waterproof male connector C2") in which male terminals 20 to fit into the respective female terminals 10 are retained by the male housings 21, 22. Specific configurations and assembling procedures for the connectors C1, C2 are as follows.

1) Specific Configuration of the Female Connector C1

Each female terminal 10 of the female connector C1 integrally includes a female type electric connection portion 10*a* and a barrel portion 10*b* formed on the rear side. The barrel portion 10*b* is bent to be crimped onto an end of an electric wire W. Further, on the immediate rear side from the female terminal 10, a rubber stopper 15 for waterproofing is mounted.

Figure 2B:
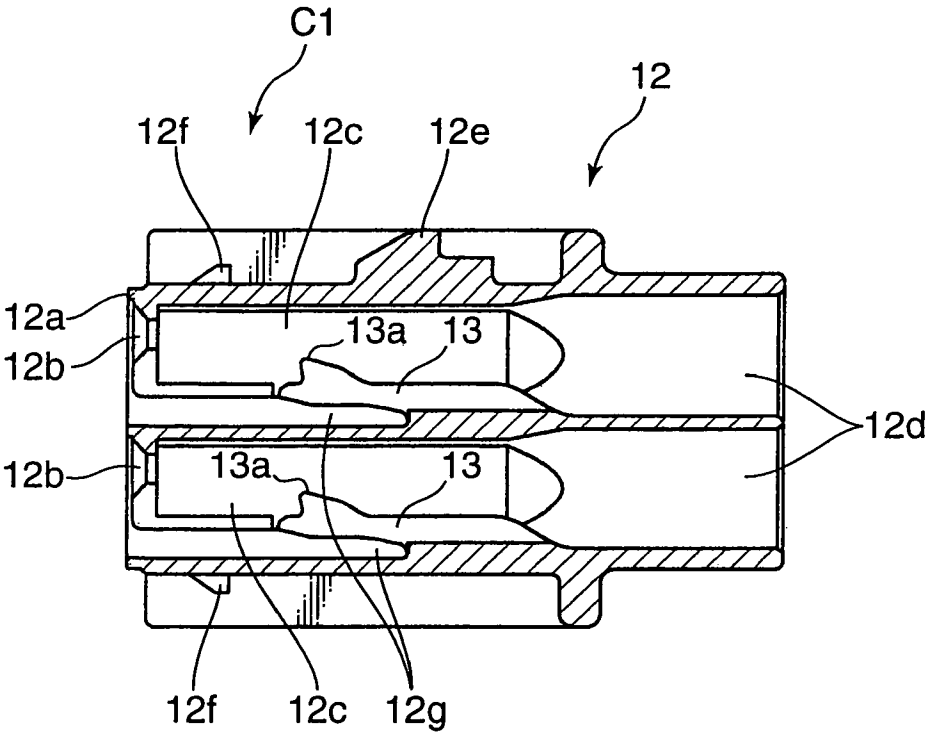
FIG. 2B is a side sectional view of the same.
Figure 2A:
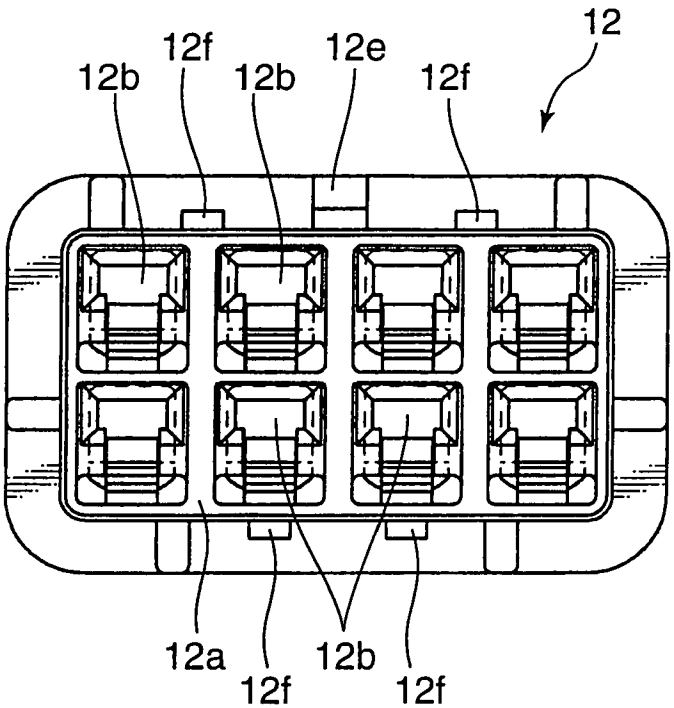
FIG. 2A is a front view showing a female housing of a female connector constituting the waterproof connector.

On the other hand, as shown in FIGS. 2A and 2B, the female housing 12 of the female connector C1 includes terminal accommodating chambers 12*c* accommodating the female terminals 10 respectively. Each terminal accommodating chamber 12*c* extends in an axial direction (forward and backward directions of the connector), and on the rear side (on the right side in FIG. 2B) thereof, there is formed a rubber stopper press-in hole 12*d* having a shape (for example, shape of a circular in cross section) to allow the rubber stopper 15 to be press-inserted thereinto. Further, the female housing 12 has a front wall 12*a*, which is formed with male terminal insertion holes 12*b* connected to the terminal accommodating chambers 12*c* respectively As will be described hereinafter, the male terminals 20 can be inserted respectively into the male terminal insertion holes 12*b* from the front side.

In each terminal accommodating chamber 12*c*, there is formed a lance 13 having a shape operable to lock a female terminal 10. Specifically, the lance 13 has a cantilevered crossbeam-like shape extending from a bottom surface of the terminal accommodating chamber 12*c* toward the front side (the left side in FIG. 2B), and has a terminal locking projection 13*a* projecting upward from the end portion of the lance 13. The lance 13 can be flexibly deformed in upward and downward directions to be shifted between a locking position where the terminal locking projection 13*a* is inserted into a through hole formed in a bottom wall of the female terminal 10 to lock the female terminal 10 (a position shown in FIG. 1) and a lock releasing position where the terminal locking projection 13*a* retreats downward from the locking position.

The female housing 12 has a ceiling wall which is provided with a connector connection locking projection 12*e* projecting upward. Each of the ceiling wall and the bottom wall is formed with a holder locking projection 12*f* projecting upward and downward at a front side of the connector connection locking projection 12*e*.

Figure 3B:
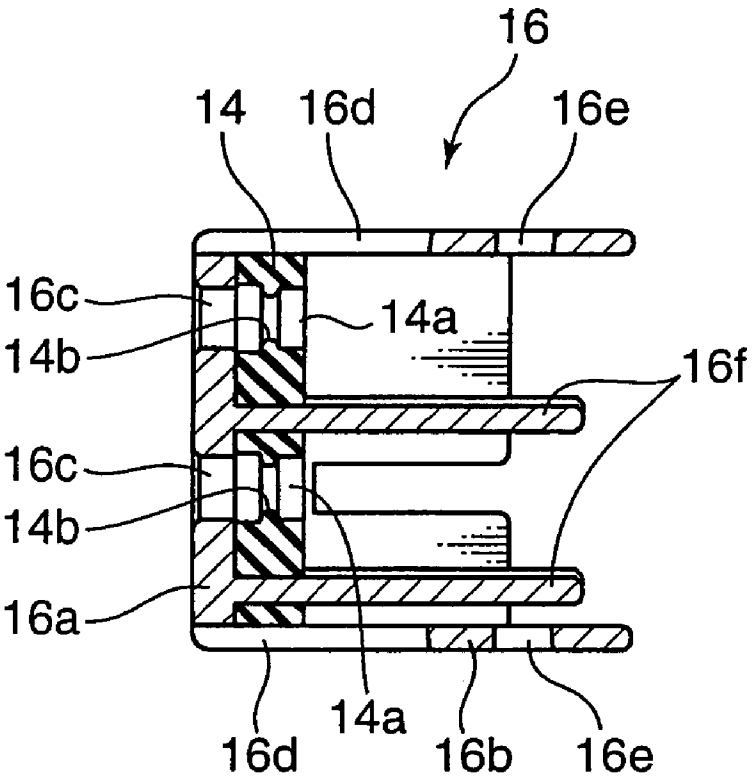
FIG. 3B is a side sectional view of the same.
Figure 3A:
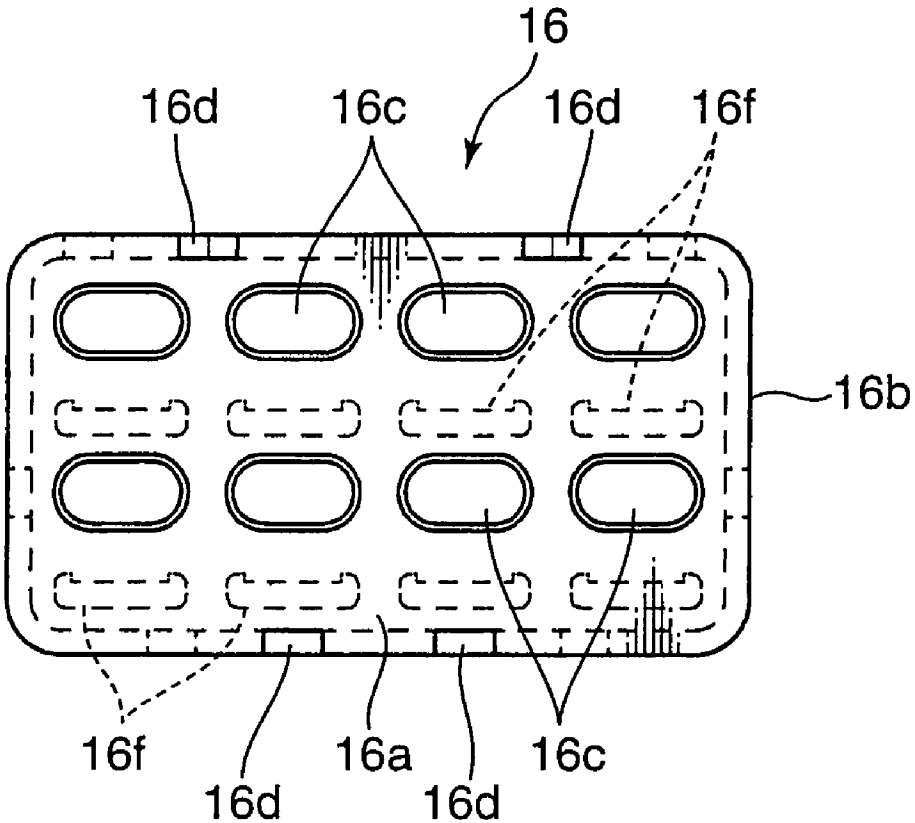
FIG. 3A is a front view showing a seal member holder of the female connector.

Further, as shown in FIGS. 3A and 3B, a sealing member holder 16 for retaining the waterproof seal member 14 can be attached to the front side of the female housing 12.

The seal member holder 16 has a cap-like shape integrally including a front side wall 16*a* having a shape operable to cover the front surface of the female housing 12 and a peripheral wall 16*b* extending from a periphery of the front side wall 16*a* to the rear side i.e. the side of the female housing 12.

The front side wall 16*a* is formed with projecting portion insertion holes 16*c* at positions corresponding to the male terminal insertion holes 12*b* respectively, into which the projecting portions 29 formed in the male housing 21 described hereinafter can be inserted respectively.

Figure 4A:
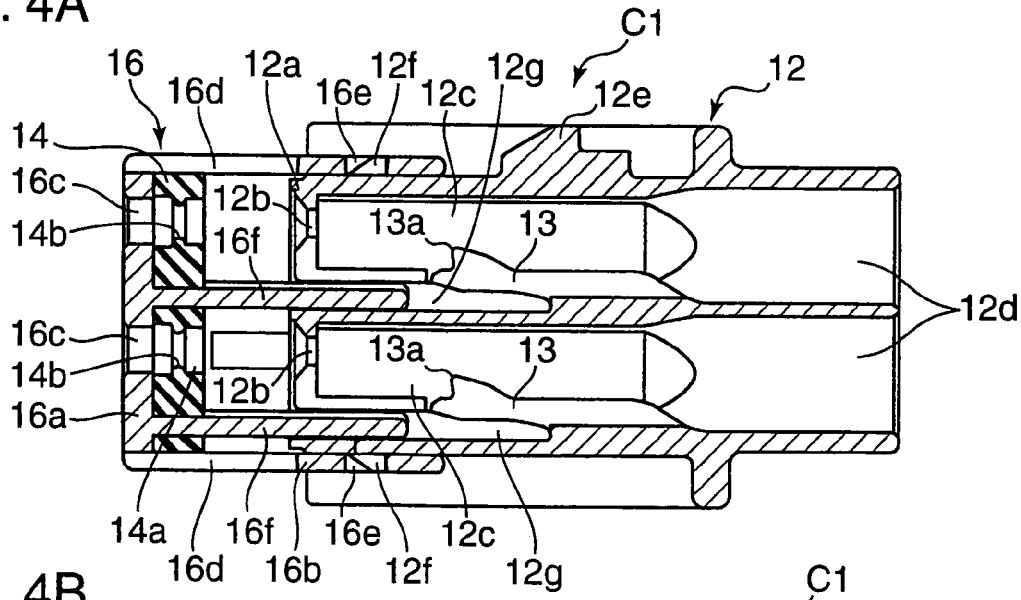
FIG. 4A is a side sectional view showing the state where the seal member holder of the female connector is positioned at a temporal locking position.

The peripheral wall 16*b* has a shape operable to fit at the outside of a front portion of the female housing 12, and is formed with elongate through holes 16*d* extending forward and backward and through holes 16*e* on the rear side of the elongate through holes 16*d* in each of an upper portion and a lower portion of the female housing 12. The elongate through holes 16*d* and the through holes 16*e* are formed at positions where the holder locking projection 12*f* of the female housing 12 can fit into either of the holes 16*d*, 16*e*. The seal member holder 16 has a temporal locking position where the holder locking projection 12*f* fits into the through hole 16*e* as shown in FIG. 4A respectively, and a complete locking position where the holder locking projection 12*f* fits into a rear end of the elongate through hole 16*d* and a rear end of the peripheral wall 16*b* comes in contact with the connector connection locking projection 12*e* (a position where the seal member holder 16 is completely attached to the female housing 12).

In other words, in the present embodiment, the holder locking projections 12*f* are used as both a temporal locking portion for retaining the seal member holder 16 at the temporal locking position and a complete locking portion for retaining the holder 16 at the complete locking position.

Figure 4B:
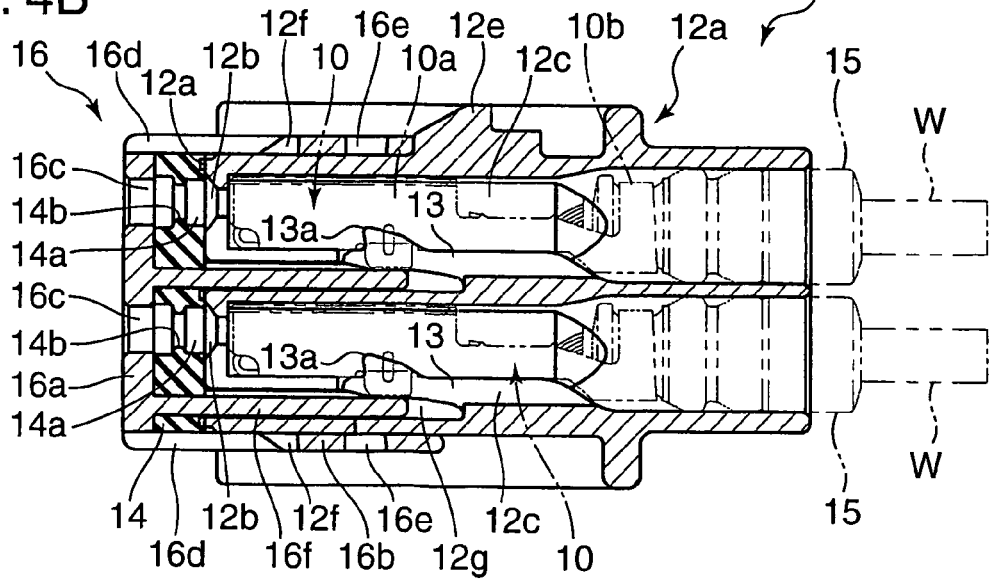
FIG. 4B is a side sectional view showing the state where the seal member holder is positioned at a complete locking position.

The seal member 14 is formed out of an elastic member such as rubber or the like in the shape of a sheet and is fastened on a substantially whole back surface of the front side wall 16*a* of the seal member holder 16. The seal member 14 has through holes 14*a* formed at positions corresponding to the male terminal insertion holes 12*b* and projection insertion holes 16*c* respectively An inner surface of the through hole 14*a* has a close contact projecting portion 14*b* projecting inward in an entire circumference at an intermediate position in an axial direction of the through hole 14*a* As shown in FIGS. 1 and 4B, the seal member 14 comes in close contact with the front surface of the housing front wall 12*a* in the state where the seal member holder 16 is completely attached to the female housing 12 (in other words, in the state where the seal member holder 16 is retained at the complete locking position).

It should be noted that means for fastening the seal member 14 to the seal member holder 16 is not especially limited. Means of press fitting, bonding or the like may be used, and the seal member 14 may be integrally formed on the seal member holder 16 by double-molding.

Further, as a feature of the female connector C1, the seal member holder 16 has a function of doubly-locking of the female terminal 10 to the female housing 12.

Specifically, the seal member holder 16 has a plurality of double-locking pieces 16*f* corresponding to the terminal accommodating chambers 12*c* respectively and penetrating from the rear side of the front side wall 16*a* of the seal member holder 16 toward the rear side in an axial direction (in other words, toward the side of the female housing 12) through the seal member 14. On the other hand, the female housing 12 is provided with insertion slots 12*g* each having a shape to allow the double-locking pieces 16*f* to be inserted thereinto respectively from the front surface side. Each insertion slot 12*g* reaches a position immediately under each of the lances 13. Then, the double-locking pieces 16*f* are inserted to the respective insertion slots 12*g*, so that the seal member holder 16 reaches the complete locking position, where each double-locking piece 16*f* penetrates under each of the lances 13 to hold the lance 13 at the locking position (in other words, at the position where the terminal locking projection 13*a* of each lance 13 fits into a through hole of the female terminal 10).

2) Specific Configuration of the Male Connector C2

Each male terminal 20 of the male connector C2 integrally includes a tab 20*a* and a barrel portion 20*b* formed on the rear side of the tab 20*a* The tab 20*a* has an extremity end formed as a male type electric connection portion 20*c* operable to fit into the electric connection portion 10*a* of the female terminal 10. The barrel portion 20*b* is bent to be crimped onto an end of an electric wire W. On immediate rear side thereof, a rubber stopper 25 for waterproofing is mounted.

On the other hand, a male housing of the male connector C2 is, for molding it, divided into a front section 21 and a rear section 22, which hold a seal member 24 therebetween.

Figure 5B:
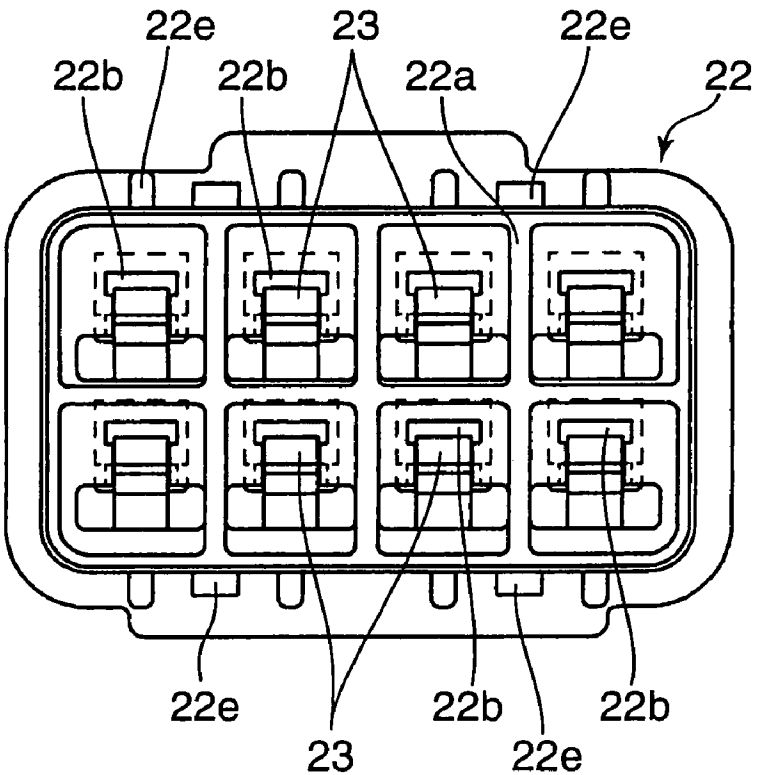
FIG. 5B is a front view showing the rear section.
Figure 5A:
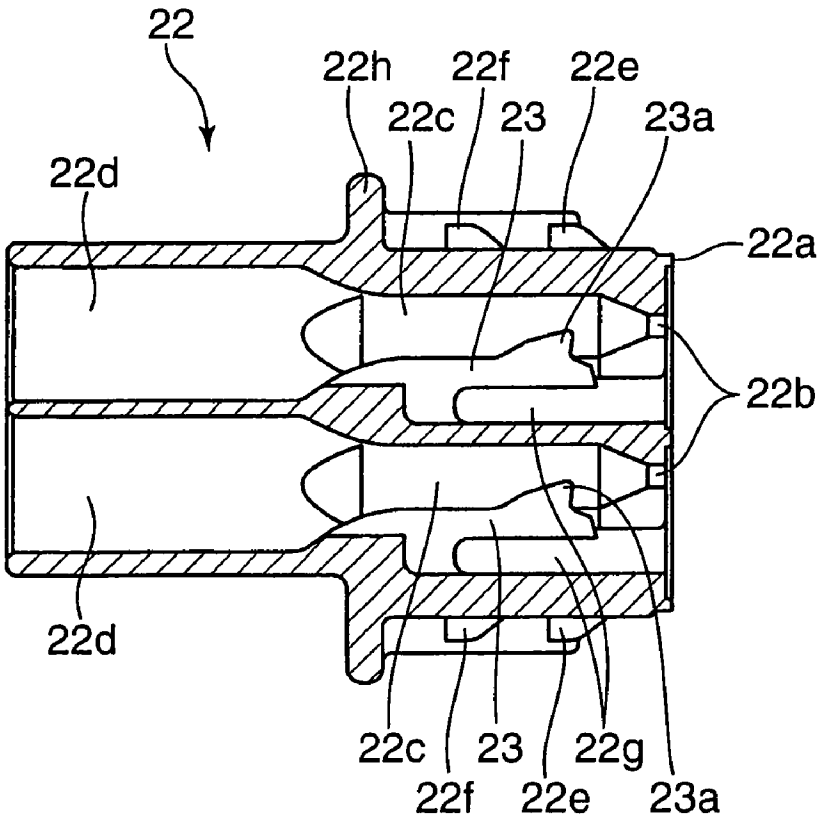
FIG. 5A is a side sectional view showing a rear section of a female housing of a male connector constituting the waterproof connector.
Figure 6B:
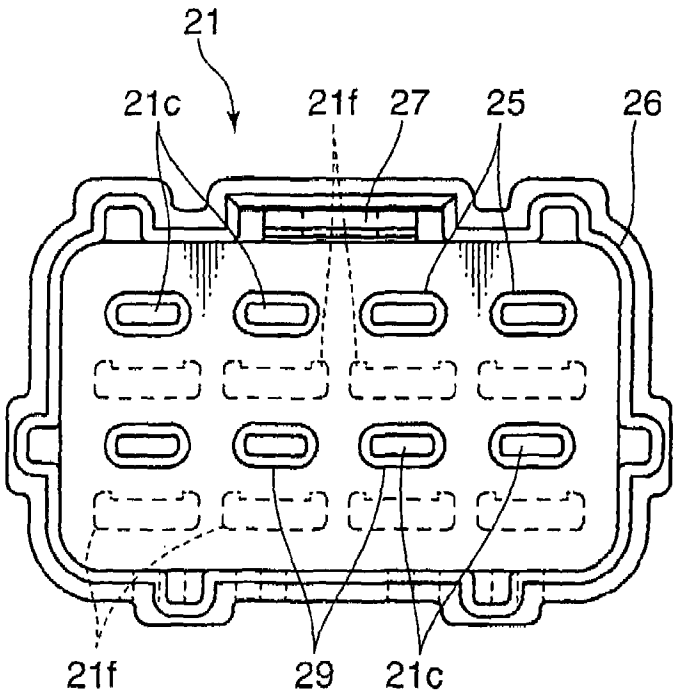
FIG. 6B is a front view of the same.
Figure 6A:
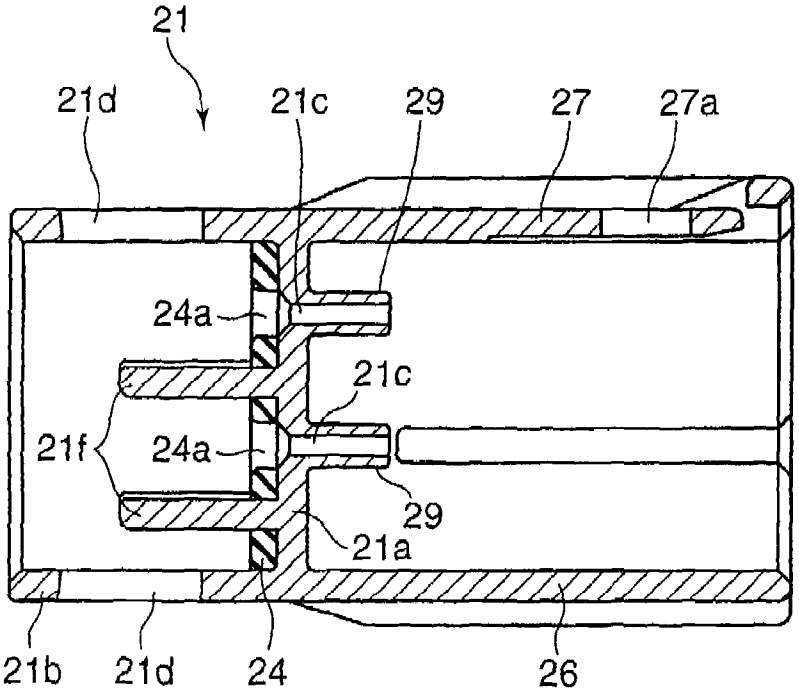
FIG. 6A is a side sectional view showing a front section of the male housing.

As shown in FIGS. 5A and 5B, the rear section 22 has terminal accommodating chambers 22*c* for accommodating the male terminals 20 respectively Each terminal accommodating chamber 22*c* extends in an axial direction (forward and backward direction of the connector), and on the rear side thereof (on the left side in FIG. 5A), there are formed rubber stopper press-in holes 22*d* each having a shape (ex. a shape with a circular cross section) to allow the rubber stopper 25 to be inserted without a gap. The rear section 22 has a front wall, which are formed with male terminal leading-out holes 22*b* for respectively leading out tabs of the male terminals 20 each accommodated in the terminal accommodating chamber 22*c* from inside of the housing to the outside. Through each male terminal leading-out hole 22*b*, the tab 20*a* of each male terminal 20 projects forward beyond the front surface 22*a* of the rear section 22.

In each of the terminal accommodating chambers 22*c*, there is formed a lance 23 for locking the male terminal 20. The lance 23, like the lance 13 of the female housing 12, has a cantilevered beam-like shape extending from the bottom surface of the terminal accommodating chamber 22*c* toward the front side (the right side in FIG. 5A), and has an end portion from which a terminal locking projection 23*a* projects upward. The lance 23 is flexible in upward and downward directions to shift the terminal locking projection 23*a* between a locking position (the position shown in FIG. 1) for locking the male terminal 20 in a through hole formed in a bottom wall of the male terminal 20 and a lock-releasing position for retreating downward from the locking position.

The terminal accommodating chambers 22*c* and the lances 23 are molded in a die assembly and thereafter the die is pulled out forward, so that there are formed large openings in the front surface 22*a* of the rear section 22 for the terminal accommodating chambers, as shown in FIG. 5B.

The rear section 22 has a ceiling wall , which are formed with a temporal locking projection 22*e* and a complete locking projection 22*f* consecutively from the front side, and a collar portion 22*h* is formed on further rear side.

On the other hand, the front section 21 integrally includes a main body wall 21 a having a shape operable to cover the front surface 22*a* of the rear section 22, a peripheral wall 21*b* extending from a periphery of the main body wall 21 a i.e. toward the rear section 22, and a hood 26 extending in the opposite direction to the peripheral wall 21*b*. In other words, the front section 21 has a shape having the peripheral wall 21*b* and the hood 26 at the front and rear sides respectively, and is internally provided with the main body wall 21*a*.

The main body wall 21*a* has male terminal through holes 21*c* and the projecting portions 29 at positions corresponding to the male terminal leading-out holes 22*b* respectively. Each male terminal through hole 21*c* has a diameter to allow a tab 20*a* of the male terminal 20 to be inserted thereinto without almost no gap. Each projecting portion 29 projects forward from the main body wall 21*a* and has a cylinder-like shape operable to cover a portion where the tab 20*a* is inserted into the male terminal through hole 21*c* (in other words, a portion behind the electric connection portion 20*c*), and has an outer diameter which allows the projecting portion 29 to come in close contact with the projecting portion 14*b* of the through hole 14*a* in the seal member 14 of the female connector C1 in an entire circumference.

Figure 7A:
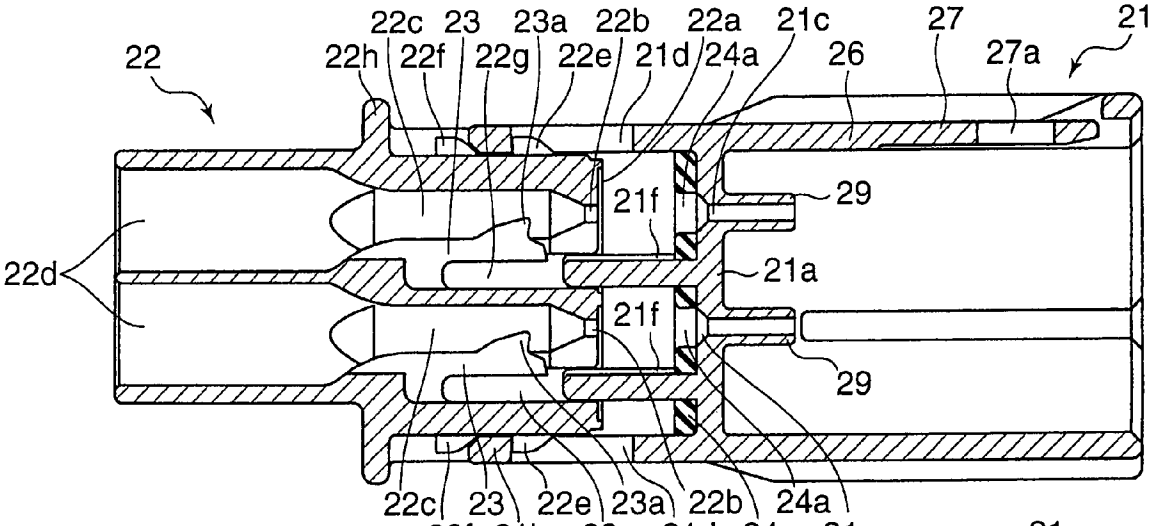
FIG. 7A is a side sectional view showing the state where the front section of the male connector is positioned at a temporal locking position.
Figure 7B:
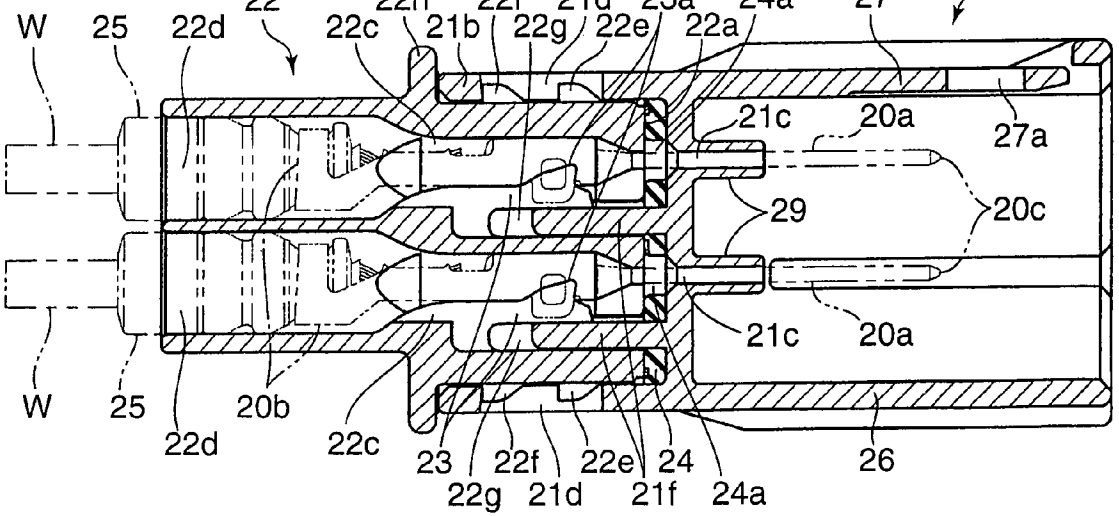
FIG. 7B is a side sectional view showing the state where the front section is positioned at a complete locking position.

The peripheral wall 21*b* has a shape operable to fit at the outside of the front portion of the rear section 22, and is formed with elongate through holes 21*d* each extending in forward and backward directions in upper and lower portions. The elongate through holes 21*d* are formed at positions where the temporal locking projections 22*e* and the complete locking projections 22*f* of the rear section 22 can fit thereinto. The rear section 22 has a temporal locking position where only the temporal locking projections 22*e* fit into the respective elongate through holes 21*d* and a rear end of the peripheral wall 21*b* comes in contact with a front side surface of the complete locking projections 22*f* as shown in FIG. 7A, and a complete locking position where a rear end of the peripheral wall 21*b* fits into the elongate through hole 21*d* in addition to the temporal locking projection 22*e* to come in contact with the collar portion 22*h* as shown in FIG. 7B (in other words, the position where the front section 21 is attached to the rear section 22 completely).

The seal member 24 is formed out of an elastic material for sealing such as rubber or the like formed in the shape of a sheet and is fastened on substantially whole area of the rear side of the main body wall 21 a of the front section 21. The seal member 24 has through holes 24*a* formed at respective positions corresponding to the male terminal leading-out holes 22*b* and male terminal through holes 21*c*. Each through hole 24*a* has a shape a size larger than the tab 20*a* The seal member 24 comes in close contact with the front surface 22*a* of the rear section 22 when, as shown in FIG. 1 and FIG. 7B, the front section 21 is completely attached to the rear section 22 (in other words, retained at the complete locking position).

In the present embodiment, means for fastening the seal member 24 to the front section 21 is not especially limited. Means of press fitting, bonding or the like maybe used, and the seal member 14 may be integrally formed on the front section 21 by double-molding. Alternatively, the seal member 24 may be fastened on the side of the front surface 22*a* of the rear section 22.

On the other hand, the hood 26 has a cylinder-like shape operable to cover the tabs 20*a* of the male terminals 20. The hood 26 is formed with a flexible locking piece 27, which has an end portion formed with a locking hole 27*a*. When the connectors C1, C2 are connected each other as will be described hereinafter, the connector connection locking projection 12*e* of the female connector C1 fits into the locking hole 27*a* to lock the connection of the connectors C1, C2.

The male connector C2 according to the present embodiment has a further function of double locking of the male terminals 20.

Specifically, the front section 21 has a plurality of double-locking pieces 21*f* corresponding to the terminal accommodating chambers 22*c*. Each double-locking pieces 21*f* projects from the rear side of the main body wall 21 a backward in an axial direction (in other words, in a direction toward the rear section 22), penetrating the seal member 24. On the other hand, the rear section 22 is provided with insertion slots 12*g* each having a shape to allow the double-locking piece 21*f* to be inserted thereinto from the front side. The insertion slot 22*g* reaches a position immediately under the insertion slot 22*g*. Then, the front section 21 reaches the complete locking position while the double-locking pieces 21*f* are inserted to the respective insertion slots 22*g*. Thereby, each double-locking piece 21*f* penetrates under each lance 23 to hold the lance 23 at the locking position (in other words, at the position where the terminal locking projection 23*a* of each lance 23 is fit into a through hole of the male terminal 20.

3) Assembling Procedures and Action of Each of the Connectors C1, C2

Assembling procedures and action of each of the connectors C1, C2 are described herebelow.

First, in the female connector C1, the seal member holder 16 is held in the female housing 12 at the temporal locking position, as shown in FIG. 4A. In other words, the peripheral wall 16*b* of the seal member holder 16 fits at the outside of the front portion of the female housing 12 while each of the double-locking pieces 16*f* of the seal member holder 16 is inserted into the insertion slot 12*g* from the front side, and the holder locking projection 12*f* of the female housing 12 fits into the through hole 16*e* of the seal member holder 16. Then, each female terminal 10 crimped onto the terminal end of the electric wire W is inserted into each of the terminal accommodating chambers 12*c* from the rear side (in other words, through the rubber stopper press-in hole 12*d*).

At this time, the lance 13 is not retained by the double-locking piece 16*f* of the seal member holder 16. Accordingly, the lance 13 is flexibly deformed so as to be temporarily retracted while insertion of the female terminal 10 proceeds. When the insertion is completed, the lance 13 is elastically restored and the terminal locking projection 13*a* fits into the through hole formed in the bottom wall of the female terminal 10, thus locking the female terminal 10 on the side of the female housing 12. Further, the rubber stopper 15 into which an electric wire W is inserted is press-inserted into the rubber stopper press-in hole 12*d* to prevent immersion of water into the female housing 12 through the rubber stopper press-in hole 12*d*.

The seal member holder 16 is further pressed toward the rear side of the female housing 12 from the temporal locking position shown in FIG. 4A to reach the complete locking position (in other words, the position where the holder locking projection 12*f* fits into the rear end portion of the elongate through hole 16*d*) shown in FIG. 4B . Thereby, the seal member 14 retained by the seal member holder 16 comes in close contact with the front surface of the housing front wall 12*a*, and each double-locking piece 16*f* of the seal member holder 16 penetrates under the lance 13 to retain the lance 13 at the locking position. This achieves the double locking of each of the female terminals 10, and assembling of the female connector C1 is completed. If any female terminal 10 is not sufficiently inserted to reach the proper position at this point, the terminal 10 prevents the shift of a corresponding lance 13 to the locking position, thus precluding pressing the seal member holder 16 up to the complete locking position. This enables detecting the half-inserted state of the female terminal 10 in advance.

In other words, the female connector C1 can perform the double locking of the female terminals 10 while maintaining its waterproofing function sufficiently, with an extremely simple structure in which only the double-locking pieces 16*f* are added to the seal member holder 16 which retains the seal member 14 for individually waterproofing each terminal.

On the other hand, in the male connector C2, the front section 21 is retained by the rear section 22 of the male housing as shown in FIG. 7A at the temporal locking position. In other words, the peripheral wall 21*b* of the front section 21 fits at the outside of the front portion of the rear section 22 while the double-locking piece 21*f* of the front-section 21 is inserted into the insertion slot 22*g* from the side of the front surface 22*a*, and the temporal locking projection 22*e* of the rear section 22 fits into the elongate through hole 21*e*.Then, the male terminals 20 crimped onto respective terminal ends of the electric wires W in advance are inserted to the respective terminal accommodating chambers 22*c* from the rear side (in other words, through the rubber stopper pressing-in hole 22*d*).

At this time, the lance 23 is not retained by the double-locking piece 21*f* of the front section 21. Accordingly, the lance 23 is flexibly deformed to be retracted once to the lock-releasing position while the male terminal 20 is inserted. When the insertion is completed, the lance 23 is elastically restored in such a manner that the terminal locking projection 23*a* fits into the through hole formed in the bottom wall of the male terminal 20 to primarily lock the male terminal 20 on the side of the rear section 22. Further, the rubber stopper 25 to which an electric wire W is inserted is press-inserted into the rubber stopper pressing-in hole 22*d* to prevent immersion of water into the male housing through the rubber stopper pressing-in hole 22*d*.

The front section 22 is further pressed toward the rear section 21 from the temporal locking position shown in FIG. 7A to reach the complete locking position (in other words, the position where the complete locking projection 22*f* fits into the rear end of the elongate through hole 21*d*) shown in FIG. 7B. Thereby, the seal member 24 fastened to the front section 22 comes in close contact with the front surface 22*a* of the rear section 22, and each double-locking piece 21*f* of the front section 21 penetrates under the lance 23 to retain the lance 23 at the locking position. This achieves the double locking of the male terminal 20, and assembling of the male connector C2 is completed. If any male terminal 20 is not sufficiently inserted to reach the proper position, the terminal 20 prevents shift of a corresponding lance 23 to the locking position, thus precluding pressing the front section 21 up to the complete locking position. This enables detecting the half-inserted state of the male terminal 20 in advance.

The connectors C1, C2 which are assembled in such manner as described above are connected with each other to make respective pairs of terminals 10, 20 connected with each other waterproof individually and effectively. Specifically, as shown in FIG. 1, the electric connection portion 20*c* of the tab 20*a* of each of the male terminals 20 fits into the electric connection portion 10*a* of the female terminal 10 through the male terminal insertion hole 12*b* of the female housing 12 to make conduction between terminals 10, 20, while the projecting portion 29 formed on each of the male terminals 20 fits into the projecting portion insertion hole 16*d* of the seal member holder 16 to make close contact with a whole circumference of the seal projecting portion 14*b* in the through hole 14*a* in the seal member 14, thus allowing the seal member 14 to prevent immersion of water into female housing 12 through the male terminal insertion hole 12*b*. Further, also in the male connector C2, even though the male housing is divided into the front section 21 and the rear section 22 for molding, each male terminal 20 is individually applied with waterproofing by the seal member 24 pressed between the portions 21, 22.

Figure 9:
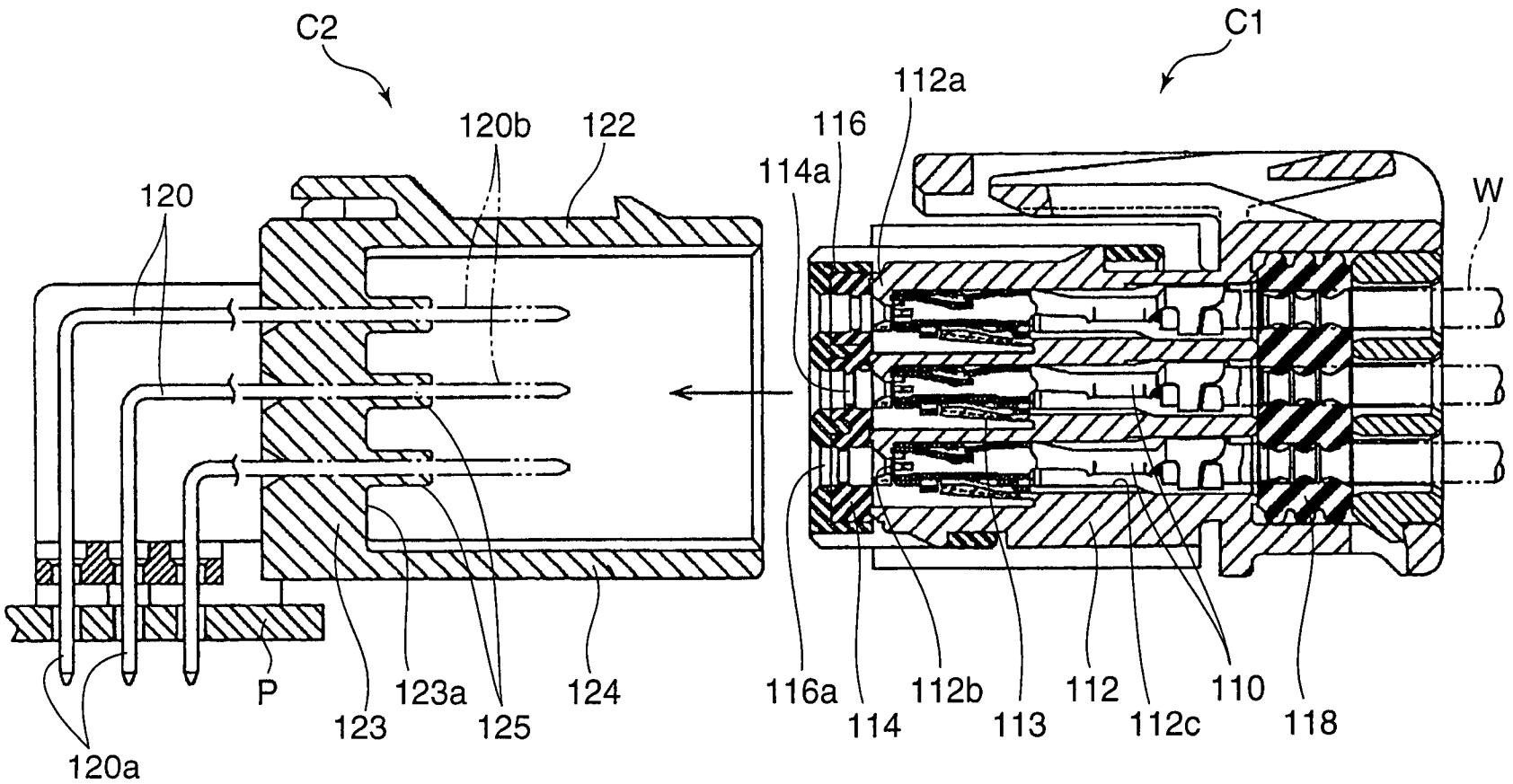
PRIOR ART FIG. 9
FIG. 9 is a side sectional view showing an example of a conventional waterproof connector.

Regardless of a specific structure of a male connecter to be a mate of a female connector C1, the present invention can be widely used as long as the female connector C1 can preserve an individual waterproof function. For example, the male connector may be like the substrate-mountable male connector C2 as shown in FIG. 9, in which pin-like male terminals 120 are integrally molded with the male housing 122.

Figure 8A:
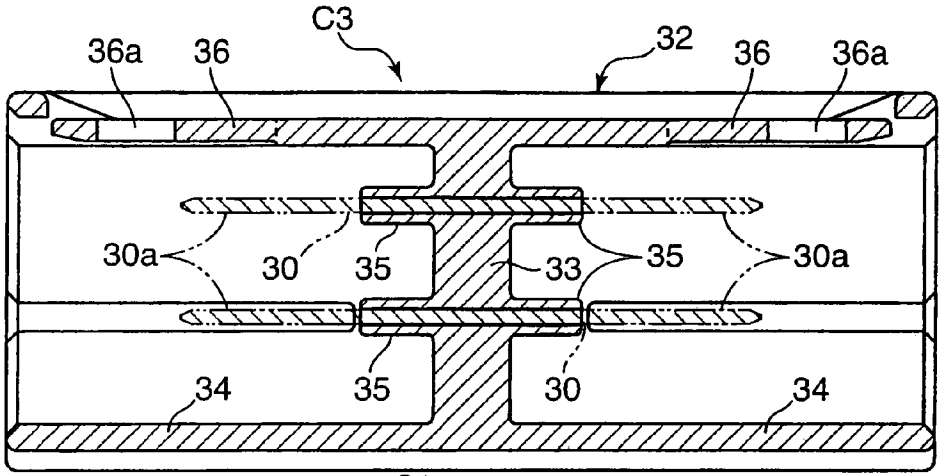
FIG. 8A is a side sectional view showing an example of a relay connector for connecting the female connector with another female connector.

Alternatively, a relay connector C3 as shown in FIG. 8 can be used as a male connector so that two waterproof female connectors C1 each having a configuration which is same as that of the structure shown in FIGS. 1 to FIG. 4 are connected via the relay connector C3.

The relay connector C3 shown in FIG. 8 is formed by integrally molding a plurality of relay male terminals 30 corresponding to the respective female terminals 10 of the female connector C1 with an insulating housing 32. Each male terminal 30 has a pin-like shape having opposite ends as electric connection portions 30*a*, and an intermediate portion, which is retained by the insulating housing 32.

The insulating housing 32 integrally has a main body wall 33 extending in a direction perpendicular to its axial direction and a cylinder-like hood 34 extending toward opposite sides in an axial direction from a periphery of the main body wall 33. The male terminal 30 has an intermediate portion, which is retained by the main body wall 33 in a water-close state and in the state where each male terminal 30 penetrates through the main body wall 33 in its thickness direction, and both electric connection portions 30*a* of each male terminal 30 are covered with the hood 34 from the outer side. Further, a locking flexible piece 36 is formed in each hood 34, being formed with a locking hole 36*a* into which a connector connection locking projection 12*e* of each female connector C1 fit.

In the relay connector C3, the main body wall 33 has opposite side surfaces, which are formed with projecting portions 35, respectively. These projecting portions 35 are provided on respective male terminals 30 like the projecting portions 29 of the male connector C2 shown in FIG. 1. Each of the projecting portion 35 is formed to be a cylinder-like shape operable to cover a portion of the male terminal 30 on the rear side (on the side of the main body wall 33) of the electric connection portion 30*a*, and has an outer diameter such that the projecting portion 35 is operable to come in close contact with a whole circumference of the seal projecting portion 34*b* of each through hole 34*a* in the seal member 34 of the female connector C1.

Further, in the example shown in the figure, as a waterproofing means for a rear portion of the female housing 12, there is used a plate-like seal member 17 into which an electric wire W is inserted in a close-contact state, instead of the seal rubber stopper 15 shown in FIG. 1. The seal member 17 is press-inserted into a rear chamber of the female housing 12, and a cover 18 is attached onto the outer side of the seal member 17.

Figure 8B:
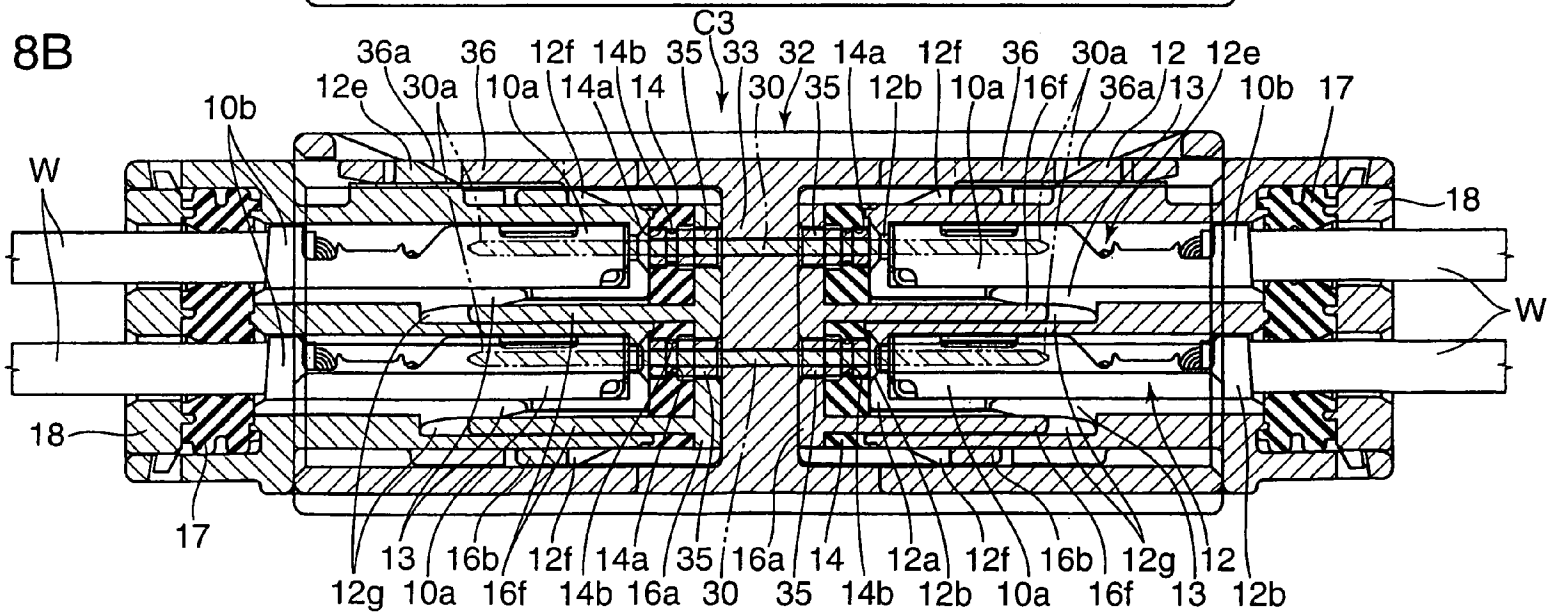
FIG. 8B is a side sectional view showing the state where the female connectors are connected with each other with the relay connector.

In the waterproof connector as described above, both electric connection portions 30*a* of each male terminal 30 in the relay connector C3 and the electric connection portion 10*a* of the female terminal 10 in each female connector C1 fit with each other as shown in FIG. 8B, thus making electrical connection between the female terminals 10 of the female connectors C1 through the male terminal 30. At the same time, the projecting portions 35 on both sides of the main body wall 33 in the relay connector C3 comes in close contact with the seal projecting portion 34*b* of the seal member 34 in each female connector C1 to make it possible to prevent each female terminal 10 individually from the immersion of water into the female housing 12 through the male terminal insertion hole 12*b* of the female housing 12 in both female connectors C1.

Other than the above, the present invention can take the following embodiment

While, in the female connector C1 shown in FIG. 1 or the like, the double-locking piece 16*f* retains the lance 13 at the locking position to pursue the double locking of the female terminal 10, the double locking portion may lock the female terminal 10 directly (in other words, perform the double locking) at another position than the locking position of the female terminal 10 by the lance 13, for example.

A specific shape of the seal member holder 16 can be set preferably. For example, the peripheral wall 16*b* may be omitted while the double-locking piece 16*f* being locked on the side of the female housing 12.

The seal projecting portion 14*b* in the seal member 14 may be omitted so that the tab 20*a* of the male terminal 20 makes uniform contact with the seal member 14 at the entire through hole 14*a* in its axial direction. However, the seal projecting portion 14*b* as shown in the figure can reduce the frictional resistance against the male terminal being inserted.

As described above, according to the waterproof female connector of the present invention and a waterproof connector including the waterproof female connector, the seal member holder is given both a function of retaining a waterproof female-side seal member and a function of double locking of the female terminal while maintaining a fine waterproof function without making larger a size of the connector or complicating the structure.

Here, if the female housing includes a temporal locking portion which locks the seal member at a temporal locking position where the double locking portion of the seal member holder is inserted to the female housing but does not pursue the double locking of the female terminal, and a complete locking portion for locking the seal member holder at a complete locking position where the seal member holder is completely attached to the female housing, it is possible to retain a seal member for waterproofing retained by the seal member holder at the proper position (a position where the seal member makes close contact with the front surface of the female housing) and to pursue the double locking of the female terminals with a simple operation of inserting the female terminal into the terminal accommodating chamber of the female housing to lock with the terminal locking portion in the state where the seal member holder is temporarily locked in the female housing at the temporal locking position and thereafter shifting the seal member holder from the temporal locking position to the complete locking position.

If the terminal locking portion of the female housing is a lance which can be shifted between the locking position for locking the female terminal and the lock-releasing position for releasing the locking of the female terminal, and the double locking portion of the seal member holder retains the lance at the locking position to doubly lock the female terminal, it is possible of the double locking of the female terminal with a simple configuration of retaining the lance including the terminal locking portion at the locking position.

If the seal member includes a front side wall covering a front surface of the female housing and having a projecting portion insertion hole into which a projecting portion of the male housing can be inserted and a peripheral wall extending from a peripheral edge portion of the front side wall toward the female housing to be engaged with the outer surface of the female housing, and the seal member is fastened onto the back surface of the front side wall at a relative position where the projecting portion insertion hole of the front side surface and a through hole of the seal member are aligned, the peripheral wall of the seal member holder can protect the seal member fastened on the back surface of the front side wall of the seal member effectively from outer side and the seal member holder can be attached to the female housing smoothly and in a stable state by engaging the peripheral wall with an outer surface of the housing in such a manner as to insert the double locking portion projecting from the back surface of the front side wall into the female housing from the front surface side.

If there is formed a seal projecting portion projecting inward than other portion and operable to come in close contact with a projecting portion of the male housing in a whole periphery at a portion in an axial direction of an inner surface of each through hole of the seal member, the seal projecting portion can reduce frictional resistance against the male terminal being inserted.

The invention claimed is:

1. A waterproof female connector which is to be connected with a male connector, the male connector being provided with a plurality of male terminals each having a front end portion as an electric connection portion, the male terminal projecting forward and held by a male housing, the male housing being formed with projections each projecting from a front surface of the male housing for a corresponding male terminal to cover a rear part of an electric connection portion, the waterproof female connector comprising:

a plurality of female terminals into which the electric connection portions of the male terminals can fit respectively;

a female housing including:

terminal accommodating chambers for accommodating the female terminals respectively;

terminal locking portions for locking the female terminals in the terminal accommodating chambers respectively; and male terminal insertion holes into which the male terminals to fit into the female terminals can be inserted respectively, the male terminal insertion holes being formed in front of the female terminals;

a waterproof seal member made of an elastic material having a shape coming in close contact with a front surface of the female housing; and a seal member holder for holding the waterproof seal member, the seal member being operable to be attached to the female housing in the state the waterproof seal member comes in close contact with the front surface of the female housing, wherein the waterproof seal member is formed with through holes corresponding to the respective male terminal insertion holes of the female housing and has a shape which allows an inner surface of the through hole to come in close contact with an outer surface of the projection of the male housing to prevent immersion of water into the male terminal insertion hole; and the seal member holder has double-locking portions which are to be inserted into the female housing from a front side thereof when the seal member holder is attached to the female housing, the double-locking portions pursue double locking of the female terminals to the female housing in the state where the seal member holder is completely attached to the female housing.

2. The waterproof female connector according to claim 1, wherein the female housing includes:

a temporal locking portion for locking the seal member holder at a temporal locking position where the double-locking portion does not pursue the double locking of the female connectors while the double-locking portion of the seal member holder is inserted to the female housing; and a complete locking portion for locking the seal member holder at a complete locking position where the seal member holder is completely attached to the female housing.

3. The waterproof female connector according to claim 1, wherein each of the terminal locking portions includes a lance which can be shifted between a locking position for locking the female terminals and a lock releasing position for releasing the locking of the female terminals; and the double-locking portion of the seal member holder pursues the double-locking of the female terminals by holding the lance at the locking position.

4. The waterproof female connector according to claim 1, wherein the seal member holder includes:

a front side wall operable to cover a front surface of the female housing, the front side wall having projection through holes into which the respective projections of the male housing can be inserted; and a peripheral wall extending from a periphery of the front side wall toward the female housing to be engaged with an outer surface of the female housing; and the seal member is fastened onto the back surface of the front side wall at a relative position where the projection insertion holes on the front side surface and the through holes of the seal member correspond with each other; and the double-locking portion projects from the back surface of the front side wall.

5. The waterproof female connector according claim 1, wherein a raised seal portion is formed in a part of the inner surface of each through hole of the seal member in an axial direction, the raised seal portion protrudes inward than other part to come in close contact with entire periphery of the projection of the male housing.

6. A waterproof connector provided with the waterproof female connector according to claim 1 and a male connector which is operable to be connected with the waterproof female connector, the male connector comprising:

male terminals each having a front end portion formed as an electric connection portion operable to fit into each of the female terminals in the waterproof female connector; and a male housing for holding the male terminals so that a portion including the electric connection portion of each male terminal protrudes forward, wherein the male housing is formed with a projection protruding from a front surface for each position of the male terminals and covering a rear part of the electric connection portion of the male terminal; and the projection is press-inserted into the through hole of the seal member of the female connector so that the outer surface of the projection comes in close contact with an inner surface of the through hole.

* * * * *